US011272781B2

(12) United States Patent
Rose et al.

(10) Patent No.: US 11,272,781 B2
(45) Date of Patent: Mar. 15, 2022

(54) HAIR COLLECTOR APPARATUS AND RELATED METHODS

(71) Applicants: Kevin W. Rose, Decatur, AR (US); Lauren E. Rose, Decatur, AR (US)

(72) Inventors: Kevin W. Rose, Decatur, AR (US); Lauren E. Rose, Decatur, AR (US)

( * ) Notice: Subject to any disclaimer, the term of this patent is extended or adjusted under 35 U.S.C. 154(b) by 318 days.

(21) Appl. No.: 16/384,302

(22) Filed: Apr. 15, 2019

(65) Prior Publication Data

US 2019/0313782 A1 Oct. 17, 2019

Related U.S. Application Data

(60) Provisional application No. 62/657,175, filed on Apr. 13, 2018.

(51) Int. Cl.
*A46B 13/02* (2006.01)
*A46B 13/00* (2006.01)

(52) U.S. Cl.
CPC ..... *A46B 13/02* (2013.01); *A46B 13/001* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 2,124,748 | A * | 7/1938 | Ransom, Jr. | A47L 15/0068 | 15/164 |
| 3,217,349 | A * | 11/1965 | Hull | A46B 17/06 | 15/311 |
| 5,035,389 | A * | 7/1991 | Wang | F16B 3/00 | 248/224.51 |
| 5,205,011 | A * | 4/1993 | Flener | A46B 17/06 | 15/104.8 |
| 2009/0090386 | A1* | 4/2009 | Nguyen | A47L 9/06 | 134/6 |

FOREIGN PATENT DOCUMENTS

| | | | |
|---|---|---|---|
| CN | 2801898 | Y | 8/2006 |
| CN | 105534008 | A | 5/2016 |
| CN | 108331137 | A | 7/2018 |
| KR | 101095286 | B1 | 12/2011 |

* cited by examiner

*Primary Examiner* — Erin F Bergner
(74) *Attorney, Agent, or Firm* — Bryan Cave Leighton Paisner LLP

(57) ABSTRACT

A hair collector apparatus including a brush. The hair collector apparatus also can include a base portion comprising a housing and a motor configured to rotate the brush. The hair collector apparatus additionally can include a visor adjustably coupled to the base portion and covering the brush in a neutral position of the visor. Other embodiments are described.

20 Claims, 8 Drawing Sheets

HAIR COLLECTOR APPARATUS AND RELATED METHODS

CROSS-REFERENCE TO RELATED APPLICATIONS

This application claims the benefit of U.S. Provisional Application No. 62/657,175, filed Apr. 13, 2018. U.S. Provisional Application No. 62/657,175 is incorporated herein by reference in its entirety.

TECHNICAL FIELD

This disclosure relates generally to bath and shower accessories, and relates more particularly to hair collecting apparatuses.

BACKGROUND

When cleaning hair in a bath or shower, natural shedding and hair-growth turnover cause hair to end up in and around the drain of the shower. To prevent the hair from getting into the drain, many individuals with longer hair place the hair on an exposed surface of the shower wall for later manual removal, and/or use a drain filter. The cleaning of a surface and/or drain filter is a tedious and dirty process, which can involve the individual manually retrieving hair from its position on the surface or reaching down to pick the hair off the drain filter. When shower water splashes on hair that has been placed on the shower walls, the hair will generally wash down the drain instead of being left for manual collection and disposal. If hair is allowed to go down the drain, the hair can accumulate and create a blockage causing the drain to back up and no longer function properly. In order to prevent or remove these clogs, individuals often pour various chemicals in the drain to initiate the degradation of the blockage. These chemicals pass through the drain into waste water treatment and processing facilities. Alternatively, individuals manually clean out the blockage from the drain.

SUMMARY

A number of embodiments include a hair collector apparatus. The hair collector apparatus can include a brush. The hair collector apparatus also can include a base portion comprising a housing and a motor configured to rotate the brush. The hair collector apparatus additionally can include a visor adjustably coupled to the base portion and covering the brush in a neutral position of the visor.

Additional embodiments include a method of providing a hair collector apparatus. The method can include providing a brush. The method also can include providing a base portion comprising a housing and a motor configured to rotate the brush. The method additionally can include providing a visor adjustably coupled to the base portion and configured to cover the brush in a neutral position of the visor.

Further embodiments include a method of using a hair collector apparatus. The method can include mounting the hair collector apparatus to a fixed surface. The hair collector apparatus can include a brush, a base portion, and a visor adjustably coupled to the base portion. The base portion can include a housing and a motor. The method also can include pulling down the visor from a neutral position of the visor covering the brush to uncover the brush and cause the motor to activate and rotate the brush.

Other embodiments and features will be in part apparent and in part pointed out hereinafter.

BRIEF DESCRIPTION OF THE DRAWINGS

To facilitate further description of the embodiments, the following drawings are provided in which.

Figure 2:
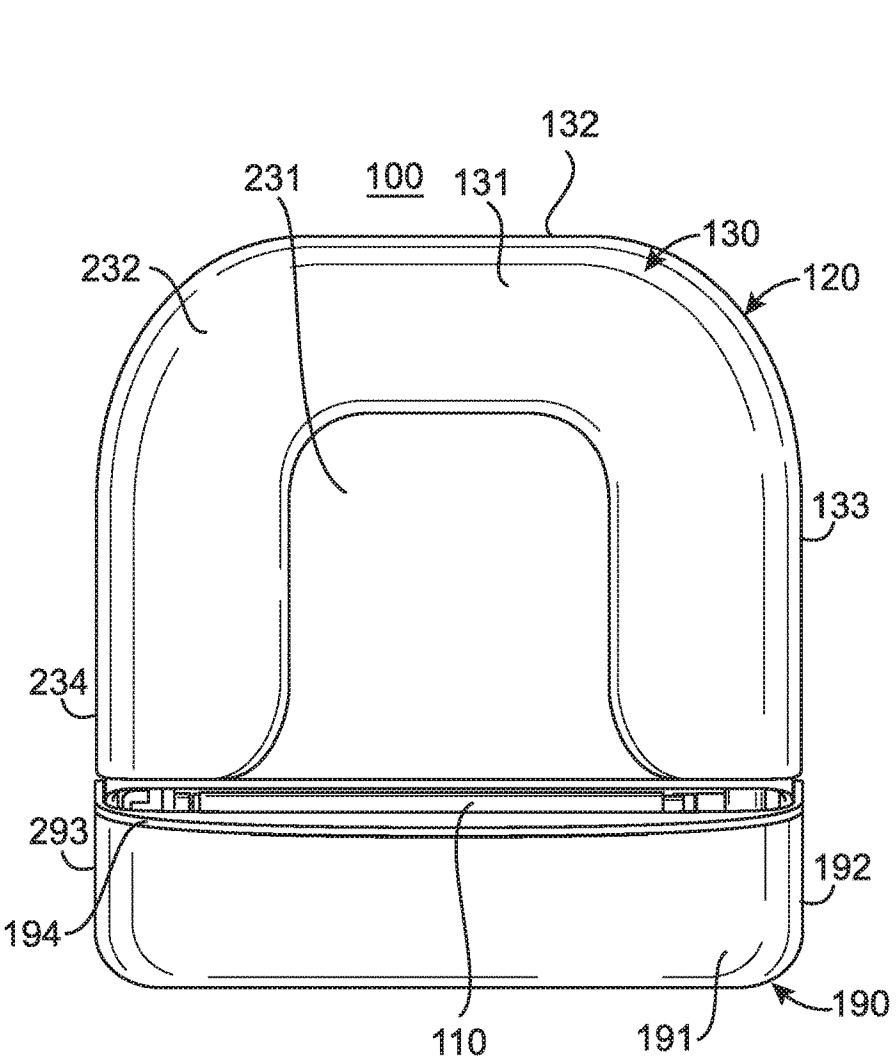
FIG. 2 illustrates a front elevation view of the hair collector apparatus of FIG. 1, showing the visor of FIG. 1 in the neutral position.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, when introducing elements of the present invention or the illustrated embodiments thereof, the articles "a," "an," "the," and "said" are intended to mean that there are one or more of the elements. The terms "comprising," "including," and "having" are intended to be inclusive and mean that there may be additional elements other than the listed elements. For example, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The orientation of the hair collector in the drawings provides the point of reference for the terms defining relative locations and positions of structures and components of the hair collector, including but not limited to the terms "upper," "lower," "above," below," "left," and "right," as used throughout the present disclosure. The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable. As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DESCRIPTION OF EXAMPLES OF EMBODIMENTS

Figure 1:
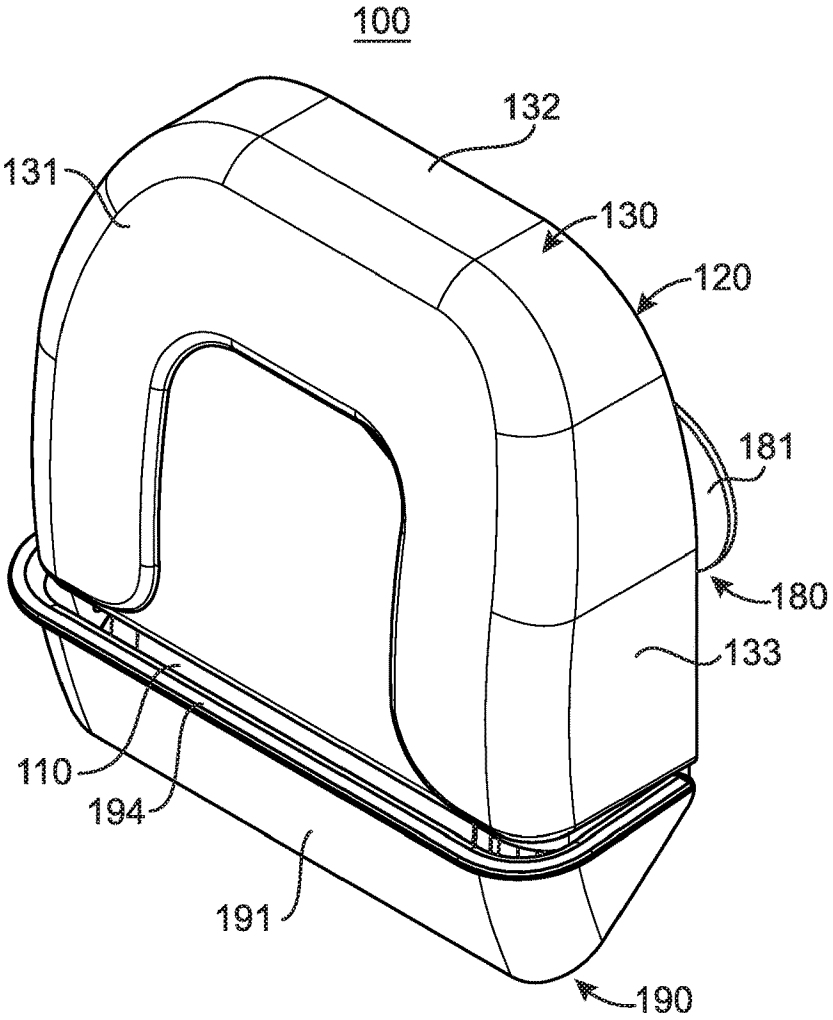
FIG. 1 illustrates a front, top, right side perspective view of a hair collector apparatus, showing a visor in a neutral position.
Figure 4:
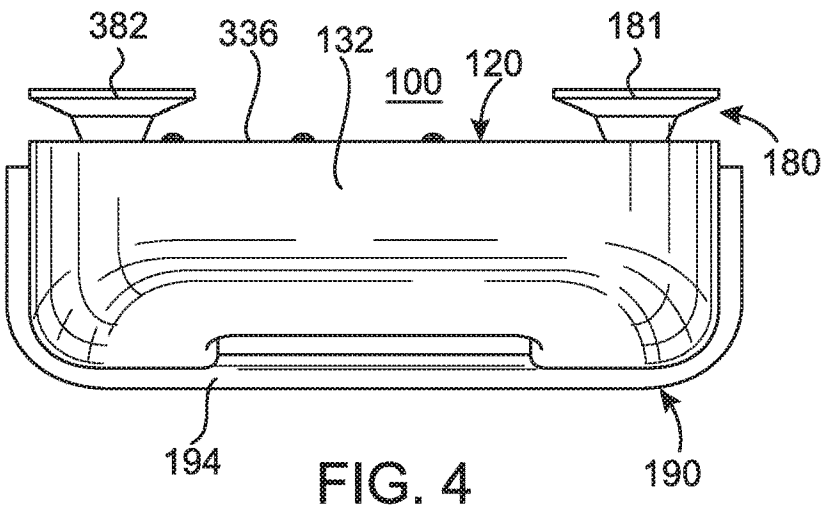
FIG. 4 illustrates a top plan view of the hair collector apparatus of FIG. 1, showing the visor of FIG. 1 in the neutral position.
Figure 3:
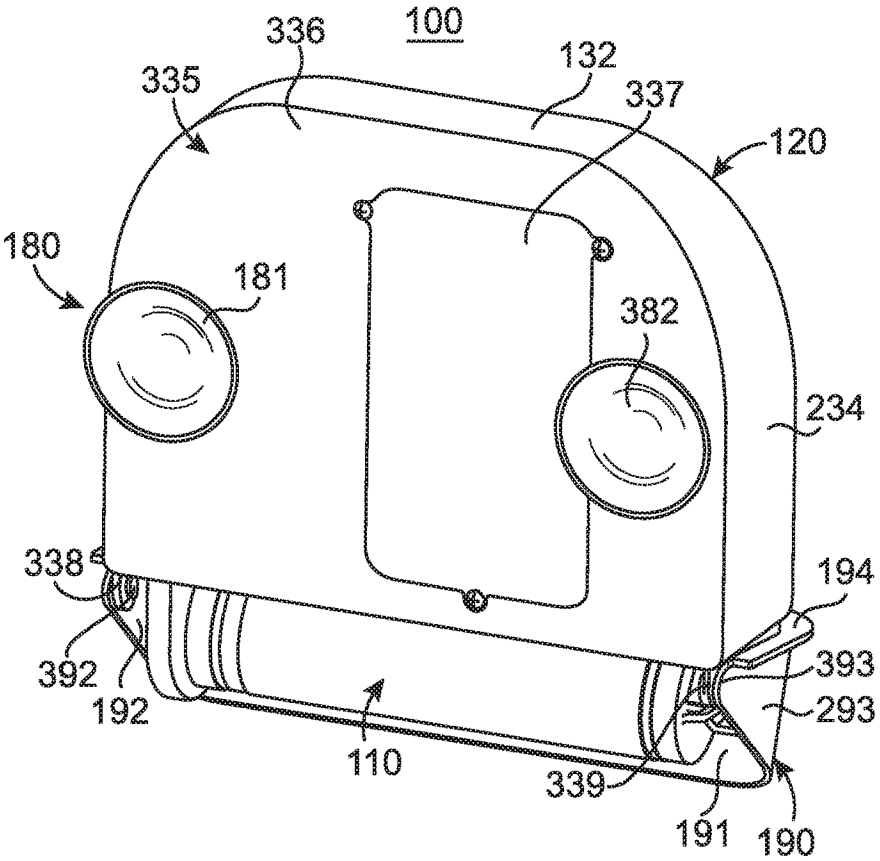
FIG. 3 illustrates a rear, top, left side perspective view of the hair collector apparatus of FIG. 1, showing the visor of FIG. 1 in the neutral position.

Turning to the drawings, FIG. 1 illustrates a front, top, right side perspective view of a hair collector apparatus 100, showing a visor 190 in a neutral position. FIG. 2 illustrates a front elevation view of hair collector apparatus 100, showing visor 190 in the neutral position. FIG. 3 illustrates a rear, top, left side perspective view of hair collector apparatus 100, showing visor 190 in the neutral position. FIG. 4 illustrates a top plan view of hair collector apparatus 100, showing visor 190 in the neutral position. Hair collector apparatus 100 is merely exemplary, and embodiments of the hair collector apparatus are not limited to embodiments presented herein. The hair collector apparatus can be employed in many different embodiments or examples not specifically depicted or described herein. In many embodiments, hair collector apparatus 100 can include a brush 110, a base portion 120, visor 190, and/or a mounting portion 180.

In a number of embodiments, base portion 120 can include a housing, which can include a housing piece 130, a housing piece 335, and/or a housing piece 337. Housing piece 130 can include a front housing portion 131, a top housing portion 132, a right side housing portion 133, and/or a left side housing portion 234. In some embodiments, such as shown in FIGS. 1-2, the interfaces between front housing portion 131 and one or more of top housing portion 132, right side housing portion 133, and/or left side housing portion 234 can be rounded surfaces, and/or the interfaces between top housing portion 132 and one or more of right side housing portion 133 and/or left side housing portion 234 can be rounded surfaces.

In a number of embodiments, such as shown in FIGS. 1-2, front housing portion 131 can include a central portion 231 and an edge portion 232. Edge portion 232 of front housing portion 131 can be adjacent to top housing portion 132, right side housing portion 133, and/or left side housing portion 234. Central portion 231 of front housing portion 131 can be recessed rearward with respect to edge portion 232 of front housing portion 131, which can beneficially prevent base portion 120 can sliding out of a hand of an individual that is holding base portion 120, and/or can facilitate ease of access to a visor lip 194 at a center of visor 190, as described below.

Figure 6:
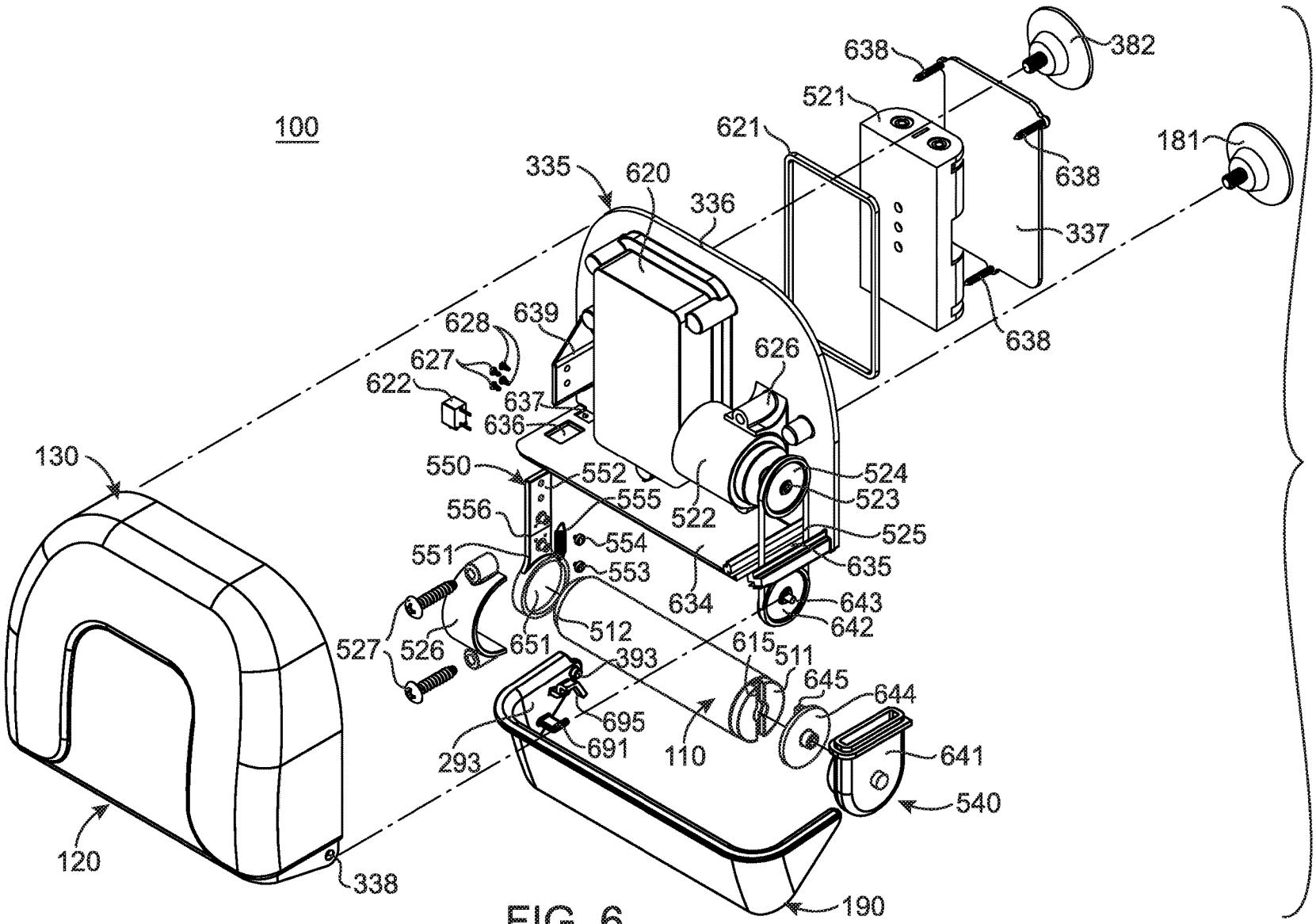
FIG. 6 illustrates an exploded view of the hair collector apparatus of FIG. 1.

In several embodiments, housing piece 335 can include a rear housing portion 336 and/or a bottom housing portion 634 (as shown in FIG. 6 and described below). Housing piece 337 can be a cover for a battery compartment in rear housing portion 336.

In many embodiments, the housing of base portion 120 (e.g., 130, 335, 337) can be made of a rigid plastic, metal, or other suitable material. In other embodiments, the housing of base portion 120 can be made of a semi-rigid plastic or other suitable material. In some embodiments, the housing of base portion 120 can be made of a rigid to semi-rigid, durable, injection molded or otherwise moldable polymer. For example, the housing of base portion 120 can be made of acrylonitrile butadiene styrene (ABS), polycarbonate, or another suitable material.

In several embodiments, hair collector apparatus 100 can be mounted to a fixed surface, such as a shower wall or another surface, using mounting portion 180. In many embodiments, mounting portion 180 can be located at a rear of base portion 120, such as attached to rear housing portion 336, and can extend rearward from rear housing portion 336. In certain embodiments, such as shown in FIGS. 1 and 3-4, mounting portion 180 can include one or more suction cups, such as suction cups 181 and 382. Suction cups 181 and 382 can be attached to base portion 120 using screws or another suitable attachment mechanism. Suction cups 181 and 382 can be configured to attach to the fixed surface using suction (e.g., decreased air pressure between the suction cup and the fixed surface compared to the air pressure outside the suction cup). In other embodiments, other suitable mounting portions can be used to mount hair collector apparatus 100 to the fixed surface, such as mounting portion 1080 shown in FIGS. 10 and 12 and described below, among others. In some embodiments, such as shown in FIGS. 3-4, suction cups 181 and 382 can be located at each side of rear housing portion 336. In other embodiments, the suction cups and/or other mounting portion can be located at another suitable position or positions on hair collector apparatus 100.

Figure 10:
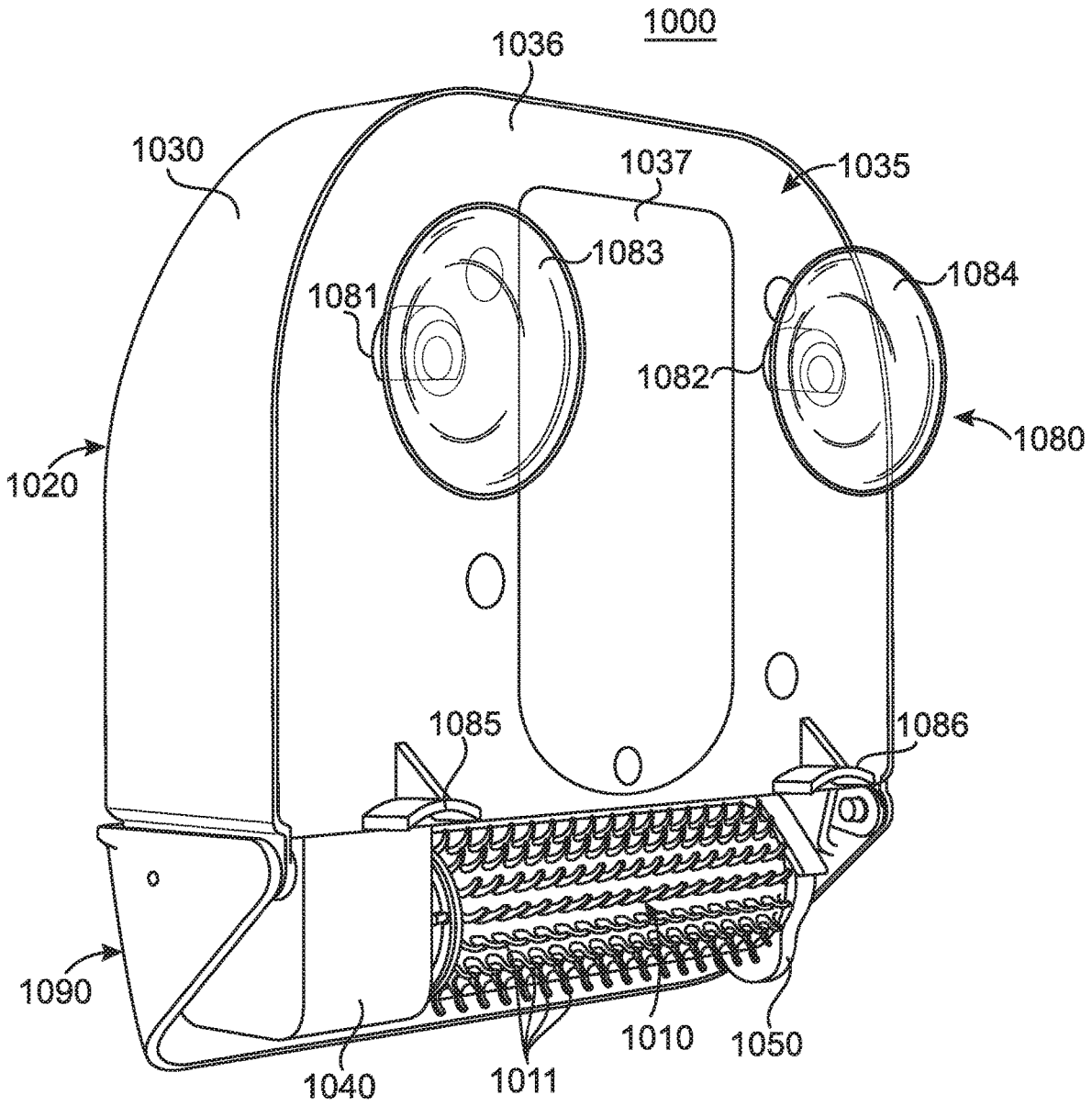
FIG. 10 illustrates a rear, left side view of a hair collector apparatus, according to another embodiment.
Figure 12:
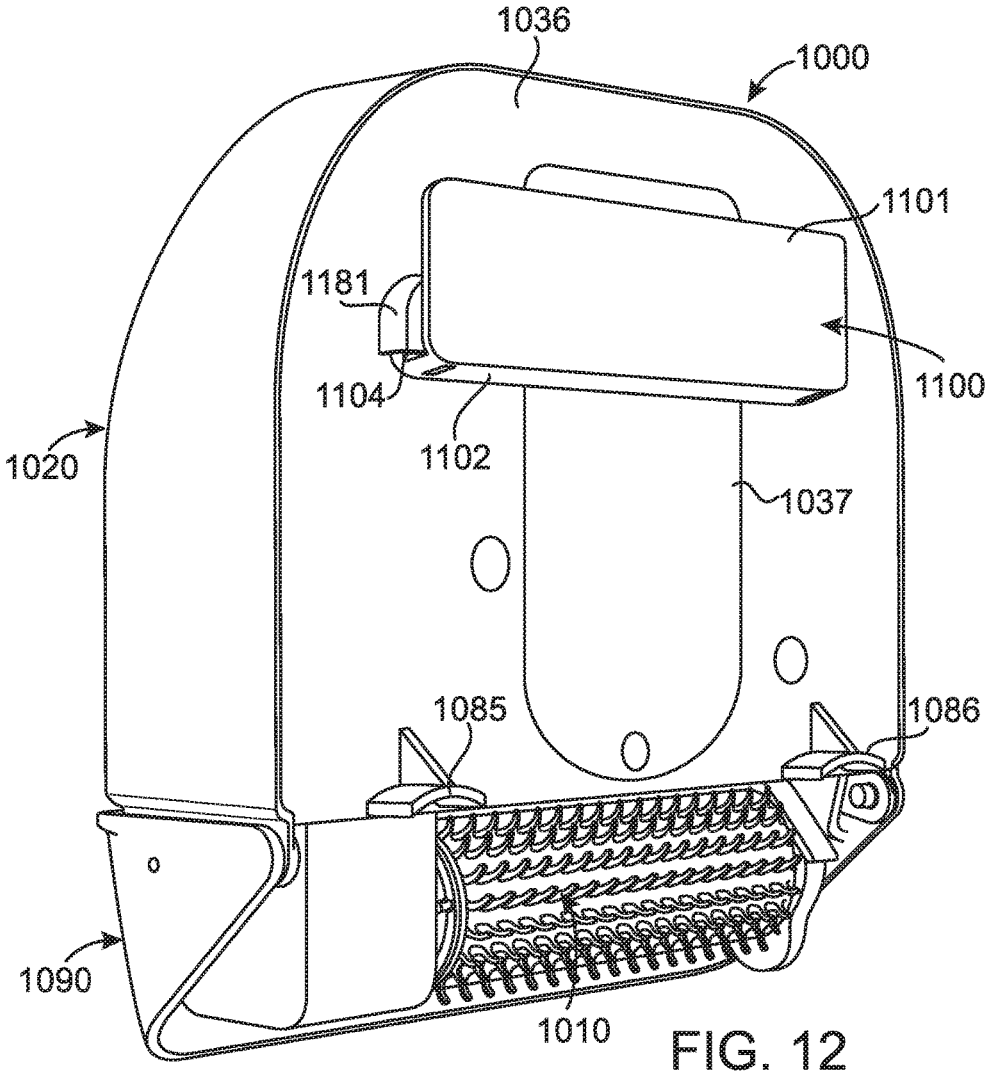
FIG. 12 illustrates a rear, left side view of the hair collector apparatus of FIG. 10 attached to the wall plate of FIG. 11.

In many embodiments, base portion 120 can hold brush 110. For example, brush 110 can be located at a bottom of base portion 120, as shown in FIGS. 1-3. In other embodiments, brush 110 can be located at another position with respect to base portion 120. Brush 110 can be rotated by base portion 120, as described below in further detail. In a number of embodiments, brush 110 can be cylindrical. In other embodiments, brush 110 can have another suitable shape. Brush 110 can be configured to collect hair. In some embodiments, brush 110 can be covered with a tricot fabric, such as a knit tricot fabric, which can catch the hair on the rough edges of the material, or another suitable material configured to collect hair. In certain embodiments, the material can be a recyclable or biodegradable material. The material can cover brush 110 evenly, unevenly, in whole, in part, and/or in a patterned design. In other embodiments, the brush can include a textured surface configured to collect hair. In the same or other embodiments, the brush can be covered in bristles configured to collect hair, such as shown in FIGS. 10 and 12 and described below. Brush 110 can collect hair when rotated, such as by catching the hair with edges, bristles, texture, and/or friction, which can wrap the hair around brush 110 and store the hair around brush 110 until brush 110 is removed from hair collector apparatus 100. In several embodiments, brush 110 can be replaced with an interchangeable brush, or exchangeable with various different types of brushes, such as a cylinder having different surfaces, materials, bristles, or textures.

In a number of embodiments, visor 190 can be adjustably coupled to base portion 120, such that the position of visor 190 with respect to base portion 120 can be adjusted by an individual using hair collector apparatus 100. In some embodiments, visor 190 can include a front visor portion 191, a right side visor portion 192, a left side visor portion 293, and/or visor lip 194. In several embodiments, such as shown in FIGS. 1-2, the interfaces between front visor portion 191 and one or more of right side visor portion 192 and/or left side visor portion 293 can be rounded surfaces. Visor lip 194 can be located at a top of one or more of front visor portion 191, right side visor portion 192, and/or left side visor portion 293, and can extend outward from hair collector apparatus 100 (e.g., visor lip 194 can extend frontward from front visor portion 191, extend rightward from right side visor portion 192, and/or extend leftward from left side visor portion 293). In many embodiments, visor lip 194 can extend frontward of first housing portion 131, which can facilitate pulling down visor lip 194. In other embodiments, the visor lip can be located at a bottom of the visor or, alternatively, between the top and the bottom of the visor. In yet other embodiments, the visor can be devoid of a visor lip and can include one or more recesses, grooves, bumps, tabs, texturing, or other mechanisms to facilitate adjusting the position of the visor. In many embodiments, visor 190 can be made of a rigid plastic, metal, or other suitable material. In other embodiments, visor 190 can be made of a semi-rigid plastic or other suitable material. In some embodiments, visor 190 can be made of a rigid to semi-rigid, durable, injection molded or otherwise moldable polymer. For example, visor 190 can be made of ABS, polycarbonate, or another suitable material. Visor 190 and the housing of base portion 120 can be made of the same material or a different material.

In some embodiments, visor 190 can be hingedly coupled to base portion 120, such as shown in FIGS. 1-3. For example, base portion 120 can include hinge elements 338 and 339 at the bottom and rear of right side housing portion 133 and left side housing portion 234, respectively, and visor 190 can include hinge elements 392 and 393 at the rear of right side visor portion 192 and left side visor portion 293, respectively. Hinge elements 392-393 of visor 190 can interface with hinge elements 338-339 of base portion 120, respectively, to provide a hinge attaching visor 190 to base portion 120. For example, hinge elements 392-393 can be circular holes and hinge elements 338-339 can be circular tabs that fit within the holes of hinge elements 392-393, respectively. In other embodiments, the hinge elements (e.g., 392-393, 338, 339) can be other suitable structural elements that provide a hinged coupling between visor 190 and base portion 120. In many embodiments, the hinge can be located along a longitudinal axis that is different from the longitudinal axis around which brush 110 rotates. In yet other embodiments, the visor (e.g., 190) can be adjustably coupled to base portion 120 in another suitable manner, such as a slidable coupling or another suitable attachment mechanism.

In several embodiments, visor 190 can substantially cover brush 110 in a neutral position of visor 190, and can be adjusted from the neutral position to one or more other positions. As shown in FIGS. 1-2, a front portion of brush 110 can be covered, at least in part, by visor 190 when visor 190 is in the neutral position shown in FIGS. 1-3. The neutral position of visor 190 can be the position of visor 190 when visor 190 is "at rest," that is, devoid of being pulled down, lifted up, or otherwise adjusted by an individual. In some embodiments, visor 190 can be weighted such that visor 190 is in the neutral position covering brush 110 when visor 190 is at rest. In other embodiments, visor 190 can be spring-loaded (e.g., in the hinge) such that visor 190 is in the neutral position covering brush 110 when visor 190 is at rest. Visor 190 can be adjusted from the neutral position to other positions, as described below in further detail.

Figure 5:
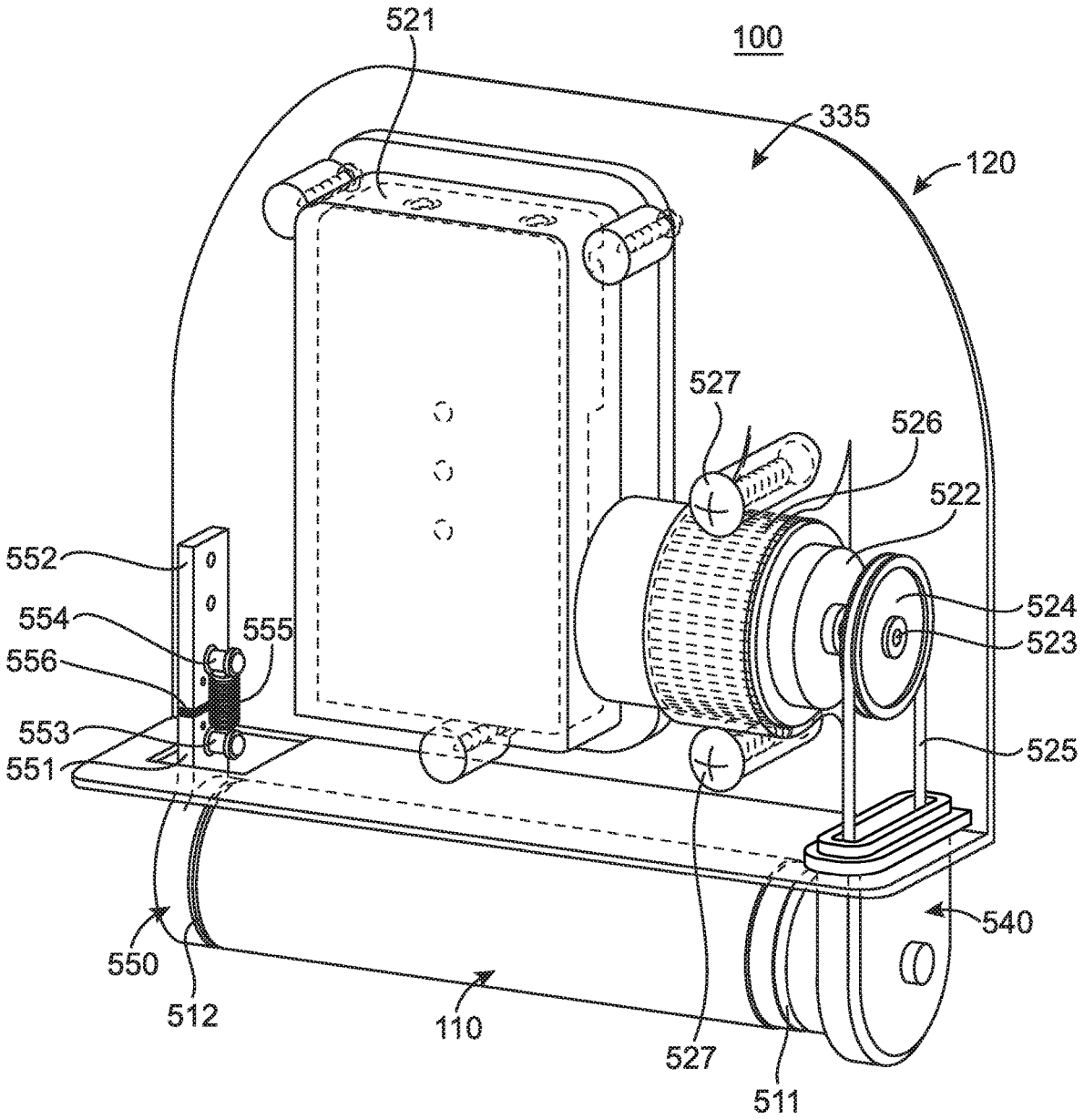
FIG. 5 illustrates a front, top, right side perspective view of the hair collector apparatus of FIG. 1, showing internal components of the base portion of FIG. 1, with the visor of FIG. 1 and the front housing piece of FIG. 1 removed.

Turning ahead in the drawings, FIG. 5 illustrates a front, top, right side perspective view of hair collector apparatus 100, showing internal components of base portion 120, with visor 190 (FIGS. 1-4) and housing piece 130 (FIGS. 1-2) removed. FIG. 6 illustrates an exploded view of hair collector apparatus 100. In many embodiments, such as shown in FIGS. 5-6, base portion 120 can include a battery holder 521, a motor 522, an axle 523, a pulley 524, a belt 525, a motor housing 526, motor housing screws 527, a first hub 540, and/or a second hub 550. Battery holder 521 can be configured to hold batteries, such as two AA batteries, to provide electric power to motor 522. Battery holder 521 can be held in a recess 620 of housing piece 335 using a frame 621. Housing piece 337 can screw into housing piece 335 using screws 638 to cover recess 620 and battery holder 521. Motor 522 can be secured to housing piece 335 using motor housing 526 and motor housing screws 527 attached to screw holes, such as a screw hole 626 of housing portion 335. Motor 522 can rotate axle 523, which can rotate pulley 524, causing belt 525 to move around pulley 524.

First hub 540 can be configured to hold a first end 511 of brush 110, and second hub 550 can be configured to hold a second end 512 of brush 110 opposite of first end 511. First hub 540 can be referred to as a drive hub because motor 522 can drive rotation of brush 110 at first hub 540. First hub 540 can include a cover 641, a pulley 642, an axle 643, and/or a drive adapter 644. Belt 525 can drive pulley 642 around axle 643 when motor 522 is activated. Drive adapter 644 can be configured to engage with first end 511 of brush 110 and drive rotation of brush 511 when drive pulley 642 and/or axle 643 is rotated. In other embodiments, drive adapter 644 can be integral with drive pulley 642. In a number of embodiments, drive adapter 644 can include teeth 645 to engage with reciprocal recesses 615 in first end 511 of brush 110. In other embodiments, pegs, gears, grooves, tabs or other suitable mechanisms can be used on drive adapter 644 or first end 511 of brush, with reciprocal elements on the other corresponding element, to rotate brush 110 when drive adapter 644 rotates. Cover 641 can be secured to bottom housing portion 634. Cover 641 can cover and/or seat in position the other elements of first hub 540, such as pulley 642, axle 643, and/or drive adapter 644.

In the embodiment shown in FIGS. 5-6, second hub 550 can be referred to as a non-drive hub, as motor 522 does not drive brush 110 at second hub 550. Second hub 550 can include a lower portion 551 and an upper portion 552, which in some embodiments can be separated by a bend point 556. Lower portion 551 can be configured to bend with respect to upper portion 552 at bend point 556. Bend point 556 can be a hinge, flexible plastic portion, or other suitable mechanism that allows lower portion 551 to bend with respect to upper portion 552. In many embodiments, second hub 550 can include a spring 555 that is connected to lower portion 551 using a screw 553 and connected to upper portion 552 using a screw 554. Spring 555 can be a tension spring that spring-biases lower portion 551 rightward to hold brush 110 in position. Lower portion 551 can include an end cap 651 to hold second end 512 of brush 110. Upper portion 552 of second hub 550 can be attached to a frame portion 639 of housing piece 335 using screws 627.

In many embodiments, first end 511 of brush 110 can be different from second end 512 of brush 110. For example, each end (e.g., 511, 512) can be different sizes, first end 511 can include recesses or gear teeth while second end 512 is smooth, and/or there can be other suitable differences. These differences at each end (e.g., 511, 512) can facilitate first end 511 fitting within first hub 540 and second end 512 fitting within second end 550, but not vice versa, such that brush 110 can be installed in the correct orientation and not installed backwards, and such that the brush will be rotated in the correct direction to facilitate collection of hair.

A switch 622 can be attached to frame portion 639 using screws 628. Switch 622 can be electrically coupled to motor 522, and can include a button, switch, knob, lever, or other suitable mechanism to activate and deactivate motor 522. In some embodiments, switch 622 can be a push button switch.

In several embodiments, bottom housing portion 634 can include apertures 635, 636, and/or 637. For example, aperture 635 can allow belt 525 to extend from pulley 525 inside base portion 120 to pulley 642 in first hub 540 below bottom housing portion 634. Aperture 636 can allow second hub 550 to extend from inside base portion 120 to below bottom housing portion 634. Aperture 637 can allow a portion of switch 622, such as a push button of switch 622, to extend below bottom housing portion 634.

In many embodiments, such as shown in FIG. 6, visor 190 can include a hook 691 and/or a tab 695 on the inner surface of left side visor portion 293. Hook 691 can be configured to facilitate releasing second hub 550 from holding brush 110, to allow the removal and/or replacement of brush 110, as described below in further detail. Tab 695 can be configured to activate and/or deactivate switch 622, as described below in further detail.

Figure 7:
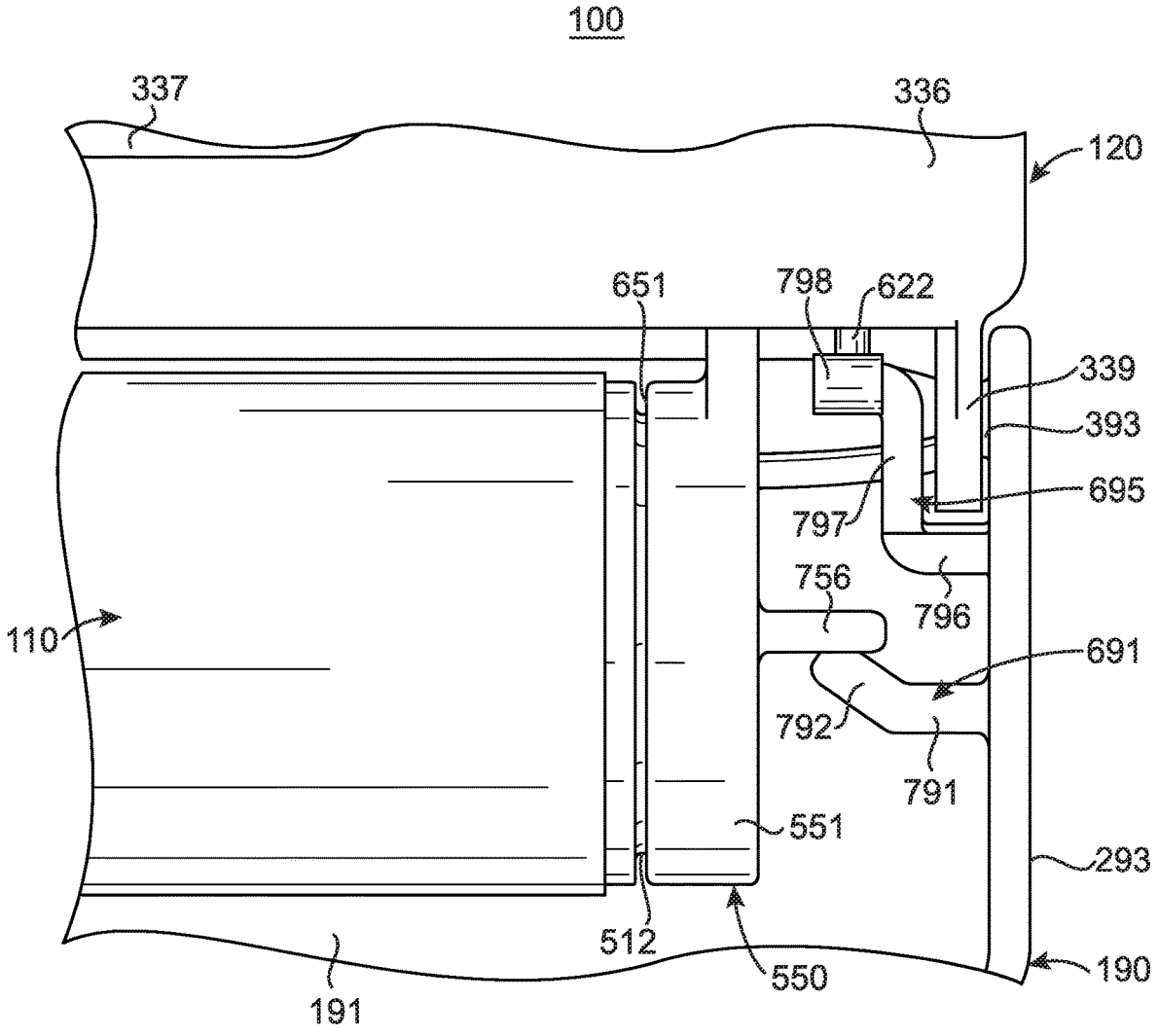
FIG. 7 illustrates a rear elevation view of a portion of the hair collector apparatus of FIG. 1, showing the visor of FIG. 1 in the neutral position and the second hub of FIG. 5 in a brush-securing position.

Turning ahead in the drawings, FIG. 7 illustrates a rear elevation view of a portion of hair collector apparatus 100, showing visor 190 in the neutral position and second hub 550 in a brush-securing position. As shown in FIG. 7, when visor 190 is in the neutral position, lower portion 551 of second hub 550 can be spring-biased to hold second end 512 of brush 110 in position to allow for rotational operation of brush 110. This position of second hub 550 can be referred to as the brush-securing position.

Figure 9:
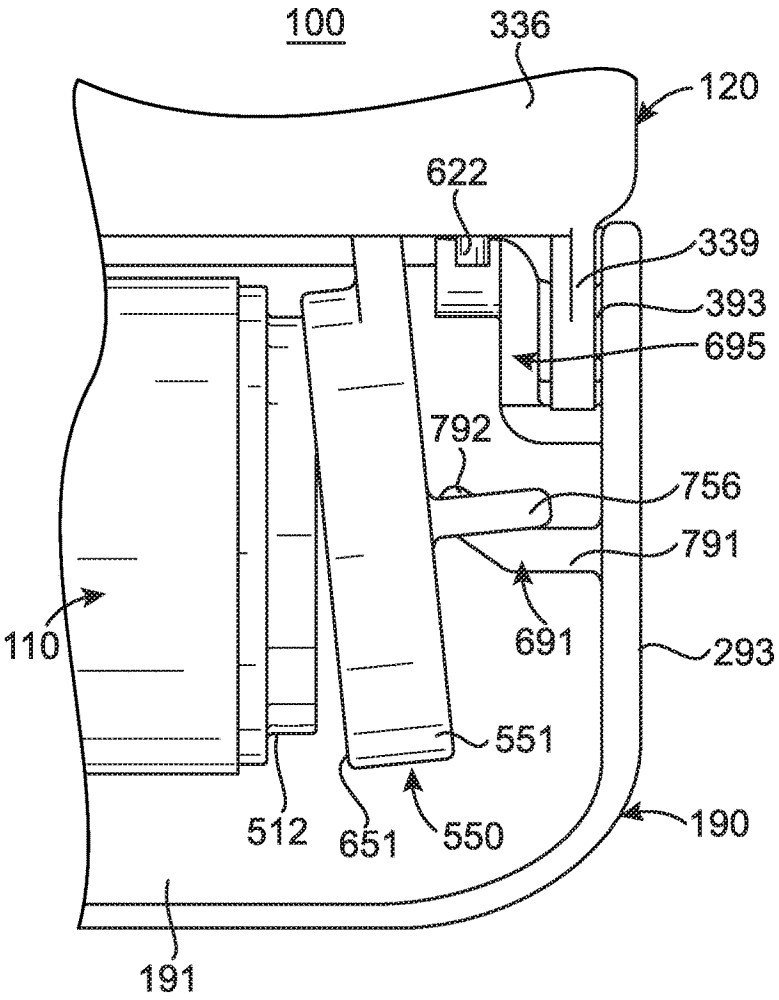
FIG. 9 illustrates a rear elevation view of a portion of the hair collector apparatus of FIG. 1, showing the visor of FIG. 1 in the lifted position and the second hub of FIG. 5 in a disengaged position.

In several embodiments, such as shown in FIG. 7, lower portion 551 of second hub 550 can include a loop 756 extending leftward opposite of end cap 651. Hook 691 can include a first portion 791 and a second portion 792. First portion 791 can extend inward (e.g., rightward) from left side visor portion 293, and second portion 792 can extend upward and inward (e.g., rightward) from the distal (e.g., rightward) end of first portion 791, which together can form a hook to catch loop 756. Loop 756 can be shaped and positioned to receive hook 691 when visor 190 is lifted up (e.g., rotated frontward and upward around the hinge connecting visor 190 to base portion 120), as shown in FIGS. 8-9 and described below in further detail.

Tab 695 can include a first portion 796, a second portion 797, and a third portion 798. First portion 796 can extend inward (e.g., rightward) from left side visor portion 293, second portion 797 can extend upward from the distal (e.g., rightward) end of first portion 796, and third portion 798 can extend inward (e.g., rightward) from the distal (e.g., upper) end of second portion 797. Third portion 798 can be positioned to interface with switch 622 to activate and/or deactivate switch 622, which can activate and/or deactivate motor 522 (FIGS. 5-6). For example, when visor 190 is pulled down from the neutral position (e.g., rotated downward and rearward around the hinge connecting visor 190 to base portion 120) to a lowered position that uncovers and exposes brush 110, third portion 798 can move with respect to with switch 622 to activate motor 522 (FIGS. 5-6), which can cause brush 110 to rotate. When visor 190 is released from being pulled down, visor 190 can return to the neutral position and again cover brush 110, and third portion 798 can move with respect to with switch 622 to deactivate motor 522 (FIGS. 5-6) to cause brush 110 to stop rotating.

Figure 8:
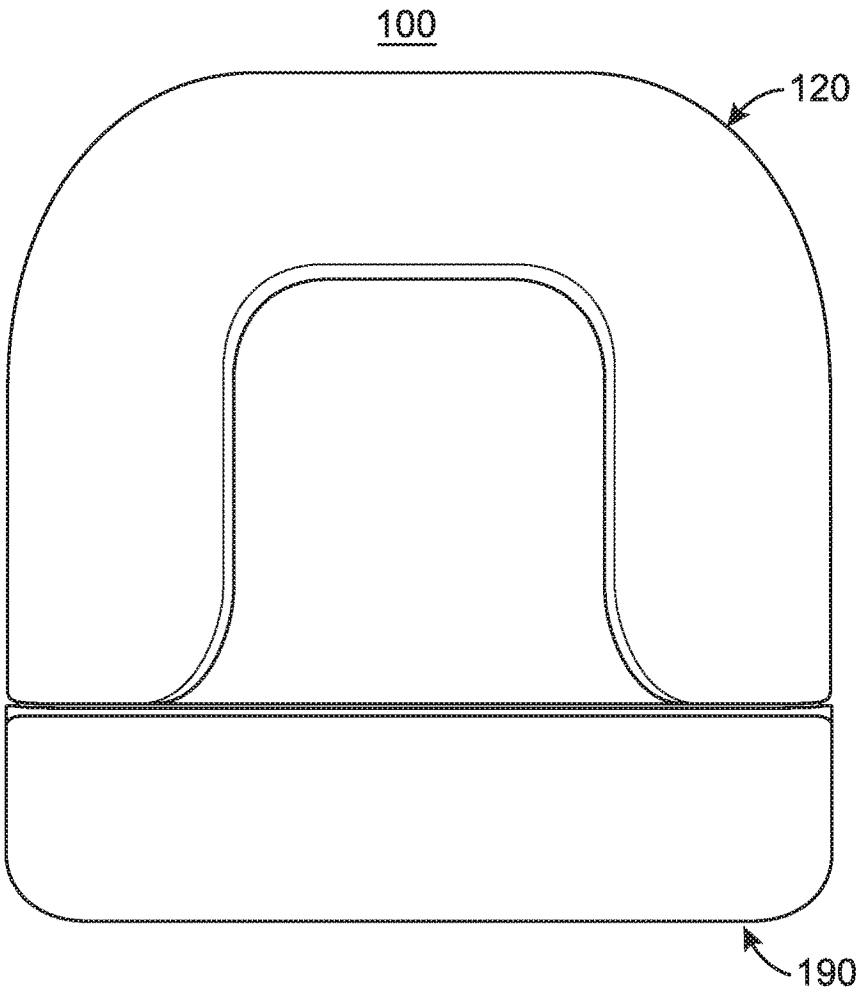
FIG. 8 illustrates a front elevation view of the hair collector apparatus of FIG. 1, showing the visor of FIG. 1 in a lifted position.

Turning ahead in the drawings, FIG. 8 illustrates a front elevation view of hair collector apparatus 100, showing visor 190 in a lifted position. FIG. 9 illustrates a rear elevation view of a portion of hair collector apparatus 100, showing visor 190 in the lifted position and second hub 550 in a disengaged position. In many embodiments, visor 190 can be lifted up (e.g., rotated frontward and upward around the hinge connecting visor 190 to base portion 120) to a lifted position, as shown in FIGS. 8-9. As shown in FIG. 9, when visor 190 is lifted up to the lifted position, hook 691 can engage with loop 756 to pull lower portion 551 of second hub 550 outward (e.g., leftward, such as rotating lower portion 551 leftward with respect to upper portion 552 around bend point 556) and release end cap 651 from holding second end 512 of brush 110. This position of second hub 550 can be referred to as the disengaged position of second hub 550, and which can allow brush 110 to be removed and/or replaced. For example, brush 110 can be removed for cleaning or replaced with another brush (e.g., an interchangeable brush or a different type of brush). As long as visor 190 is in the lifted position, second hub 550 can remain in the disengaged position, which can allow the individual to replace brush 110. When visor 190 is released from being lifted up, visor 190 can return to the neutral position, causing hook 691 to disengage with loop 756, and allowing spring 555 (FIGS. 5-6) to pull lower portion 551 of second hub 550 back inward (e.g., rightward) to the brush-securing position, such that end cap 651 can hold second end 512 of brush 110.

Turning ahead in the drawings, FIG. 10 illustrates a rear, left side view of a hair collector apparatus 1000. Hair collector apparatus 1000 is merely exemplary, and embodiments of the hair collector apparatus are not limited to embodiments presented herein. The hair collector apparatus can be employed in many different embodiments or examples not specifically depicted or described herein. In some embodiments, hair collector apparatus 1000 can be similar to hair collector apparatus 100 (FIGS. 1-9), and various components and/or materials of hair collector apparatus 1000 can be similar or identical to various components and/or materials of hair collector apparatus 100 (FIGS. 1-9). For example, hair collector apparatus 1000 can include a brush 1010, a base portion 1020, a visor 1090, and/or a mounting portion 1080.

Brush 1010 can be similar to brush 100 (FIGS. 1-3, 5-7, and 9). Brush 1010 can include bristles 1011, as shown in FIG. 10. In some embodiments, bristles 1011 can be have bent or hooked distal ends to facilitate collecting hair. The length of bristles 1011 can be uniform or varied (e.g., some bristles can be longer than other bristles). In some embodiments, brush 1010 can have a larger diameter with shorter bristles, and in other embodiments, brush 1010 can have a smaller diameter to allow for longer bristles, which can facilitate more hair being collected and stored. In some embodiments, at least a portion of bristles 1011 can be feathered at the distal ends of bristles 1011, such as split into multiple smaller bristles at the distal end of each bristle, which can advantageously facilitate collection and/or storage of fine hair.

Base portion 1020 can be similar to base portion 120 (FIGS. 1-9), and various components of base portion 1020 can be similar or identical to various components of base portion 120 (FIGS. 1-9). Base portion 1020 can include a housing, which can include a housing piece 1030, a housing piece 1035, and/or a housing piece 1037. Housing piece 1030 can be similar or identical to housing piece 130 (FIGS. 1-2), housing piece 1035 can be similar to housing piece 335 (FIG. 3), and housing piece 1037 can be similar to housing piece 337 (FIG. 3). Housing piece 1035 can include a rear housing portion 1036, and housing piece 1037 can be a cover for a battery compartment in rear housing portion 1036. Base portion 1020 also can include a first hub 1040 and a second hub 1050. First hub 1040 can be similar or identical to first hub 540 (FIG. 5-6), and second hub 1050 can be similar or identical to second hub 550 (FIGS. 5-7, 9). First hub 1040 and second hub 1050 can be configured to hold brush 1010. Base portion 1020 also can include various internal components, which can be similar or identical to the internal components of base portion 120, as shown in FIGS. 5-6. Base portion 1020 can be hingedly connected to visor 1090. Visor 1090 can be similar or identical to visor 190 (FIGS. 1-4, 6-9).

Mounting portion 1080 can be similar to mounting portion 180 (FIGS. 1, 3-4), which can be configured to mount hair collector apparatus 1080 to a fixed surface. Mounting portion 1080 can differ from mounting portion 180 (FIGS. 1, 3-4) in some aspects. For example, mounting portion 1080 can include insertion grooves, such as insertion grooves 1081 and 1082. Insertion grooves 1081-1082 can be configured to removably and slidably attach to various different attachment mechanisms. In some embodiments, insertion grooves 1081-1082 can extend rearward from rear housing portion 1036, and can have an opened-down horseshoe shape, with a flange around the rearmost extension, to hold the various different attachment mechanisms. For example, as shown in FIG. 10, suction cups 1083 and 1084 can be slidably inserted into insertion grooves 1081 and 1082, respectively. Suction cups 1083-1084 can be used to attach hair collector apparatus 1000 to a fixed surface (e.g., a shower wall) using suction. In some embodiments, lower support pieces 1085 and 1086 can extend rearward from rear housing portion 1036, as shown in FIG. 10. Lower support pieces 1085-1086 can provide spacers on the lower portion of rear housing portion 1036, which can extend rearward a distance approximately the same as insertion grooves 1081-1082, which can space both the lower portion and upper portion of rear housing portion 1036 away from the fixed surface approximately equidistant.

Figure 11:
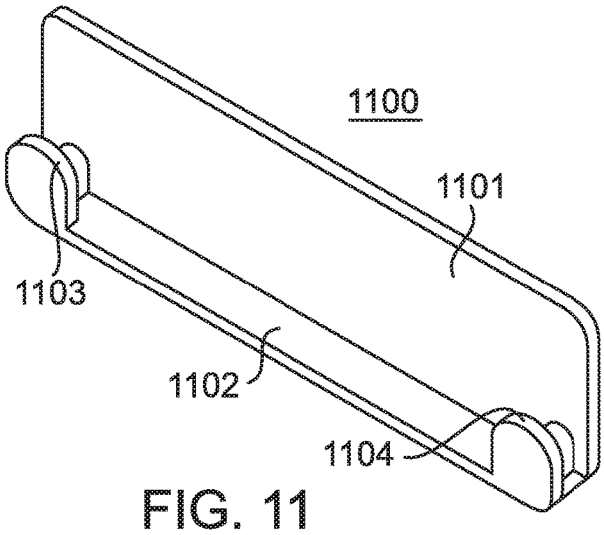
FIG. 11 illustrates a front, top, right side perspective view of a wall plate, according to another embodiment.

Turning ahead in the drawings, FIG. 11 illustrates a front, top, right side perspective view of wall plate 1100. Wall plate 1100 is merely exemplary, and embodiments of the wall plate are not limited to embodiments presented herein. The wall plate can be employed in many different embodiments or examples not specifically depicted or described herein. In many embodiments, as shown in FIG. 11, wall plate 1100 can include a rear portion 1101, a bottom portion 1102, and hooks 1103 and 1104. Rear portion 1101 can be a planar portion configured to attach to a fixed surface (e.g., a shower wall) using an attachment mechanism, such as an adhesive, hook and loop tape, or another suitable attachment mechanism. Bottom portion 1102 can extend frontward from rear portion 1101. Hooks 1103-1104 can extend frontward from rear portion 1101 and upward from bottom portion 1102 at each side of wall plate 1100, and can be shaped to conform to insertion grooves 1081-1082 (FIG. 10).

Proceeding to the next drawing, FIG. 12 illustrates a rear, left side view of hair collector apparatus 1000 attached to wall plate 1100. As shown in FIG. 12, hair collector apparatus 1000 can be configured to removably attach to wall plate 1100. For example, wall plate 1100 can be attached to the fixed surface, hook 1104 can be slidably inserted in insertion groove 1082, and hook 1103 (FIG. 11) can be slidably inserted in insertion groove 1081 (FIG. 10). In many embodiments, hair collector apparatus 1000 can be readily attached and/or detached from wall plate 1100, which can facilitate mounting hair collector apparatus 1000 to the fixed surface and/or removing hair collector apparatus 1000 for mobile use.

In use, the hair collector apparatus (e.g., 100 (FIGS. 1-9), 1000 (FIGS. 10, 12)) can be used to collect hair, which can beneficially prevent hair from entering the shower drain and prevent drainage backup and/or blockages in the shower drain. The hair collected in the hair collector apparatus can be contained and stored within the hair collector apparatus for later disposal. The visor (e.g., 190 (FIGS. 1-4, 6-9), 1090 (FIGS. 10, 12)) can advantageously prevent shower water from washing the collected hair off of the brush (e.g., 110 (FIGS. 1-3, 5-7, and 9), 1010 (FIGS. 10, 12)). The hair can be stored in the hair collector apparatus until later disposal. Collecting the hair can be performed by the brush rotating to wrap up the hair and prevent the hair from going down the drain. The hair collector apparatus can collect the hair when the hair is wet or dry, and can be used before, during, or after a bath or shower. The hair collector apparatus can collect the hair from the hands or body of an individual, and from surfaces, curtains, drain filters, and/or other areas. In several embodiments, the hair collector apparatus can be mounted to a fixed surface, such as a shower wall, and/or can be used in a mobile manner by an individual. The hair collector apparatus can be mounted outside of and away from the drain.

In some examples, the brush can be removed for cleaning and replaced after cleaning. For example, the brush can be cleaned of the wrapped hair by cutting off the wrapped hair. In another example, a comb can be used to remove the wrapped hair. In a further example, a second brush can be used that turns in an opposite orientation and is in contact with the brush to scrape away the wrapped hair. In yet another example, a material on the surface of the brush can be removed and discarded, along with the wrapped hair, which can expose a fresh material that was underneath the removed material, or alternatively, a new material can be applied to the brush. In other examples, the brush can be removed and replaced with another brush. In a number of embodiments, the brush can be removed, and cleaned and/or replaced when hair covers the brush. In some embodiments, hair collector apparatus can include a timer or counter to notify the individual to replace the brush after a predetermined amount of elapsed time since the brush was installed, after a predetermined amount of usage time in which the brush has been rotated, after a predetermined number of motor activations, after a predetermined number of rotations, or another suitable measurement.

In many embodiments, the brush can be located at a bottom of the base portion (e.g., 120 (FIGS. 1-9), 1020 (FIGS. 10, 12)) and can be oriented horizontally and parallel to the fixed surface on which the hair collector apparatus is mounted, as described above. In other embodiments, the brush can be located in another position of the hair collector apparatus, can have a different orientation, can be secured in a different manner, and/or can use a different drive mechanism. For example, the brush can be on top of a mounted casing containing a rotating mechanism. As another example, the brush can be located completely internally and can be exposed when activating the brush, such as the brush being covered by sliding doors that are opened by a motion-activated mechanism or a manual switch.

In some embodiments, the brush can rotate while the visor is pulled down and can continue rotating until the visor is released to return to the neutral position, as described above. In other embodiments, the brush can stop rotating after a predetermined amount of time, even if the visor is still pulled down. In yet other embodiments, the rotation of the brush can be activated using a different mechanism. For example, a button or a motion-activated switch can be used to activate and/or deactivate rotation of the brush. In some embodiments, a battery-powered motor can be used to drive the rotation of the brush, as described above. In other embodiments, the hair collector apparatus can be plugged into a wall outlet or solar powered. In yet other embodiments, the brush can be rotated without an electric motor. For example, the brush can be rotated using a manual knob, a spring-wound or pull-back mechanism, a tension-holding mechanism, or another suitable mechanism. In a number of embodiments, the drive mechanism can be a belt, interlocking gears, a pulley system, or another suitable mechanism of transferring rotational force to the brush.

In some embodiments, the first hub (e.g., 540 (FIGS. 5-6), 1040 (FIG. 10)) can be a drive hub and the second hub (e.g., 550 (FIGS. 5-6, 7, 9), 1050 (FIG. 10)) can be a non-drive hub, as described above. In other embodiments, both hubs can be drive hubs, and the brush can have teethed or geared ends on both ends to engage with reciprocal elements in the drive hubs. In a number of embodiments, the brush can be secured in place for operation when the second hub is in the brush-securing position and can be released when the second hub is in the disengaged position, as described above. In other embodiments, the brush can be secured and/or removed using other mechanisms. For example, an internal compression spring can be used inside the cylinder of the brush that applies outward pressure on each end of the brush, which can allow an end of the brush to be depressed to create clearance between fixed hubs for removal for the brush. As another example, the hubs can be pre-attached to the brush to form a replaceable unit, and the brush can be replaced by removing the hubs, along with the attached brush, and replacing the removed unit attaching another such unit. In yet another example, the brush can be released by opening a retention piece on one or both of the hubs to allow a male element at the end of the brush to slide out through the opening of the retention piece, or vice versa.

In some embodiments, the visor can completely enclose the brush. In other embodiments, the visor can partially cover the brush. In several embodiments, the visor lip (e.g., 194 (FIGS. 1-4) of the visor modified, such as changing the width of the visor lip, adding finger rests, or other suitable modifications. In some embodiments, the widths and/or heights of the visor and/or the opening to access the brush when the visor is in the lowered position can be modified.

Although the hair collector apparatus has been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that various element of FIGS. 1-12 can be interchanged or otherwise modified, and that the foregoing discussion of certain of these embodiments does not necessarily represent a complete description of all possible embodiments. As various changes could be made in the above constructions, products, and methods without departing from the scope of the invention, it is intended that all matter contained in the above description and shown in the accompanying drawings shall be interpreted as illustrative and not in a limiting sense. It is understood that any feature of any embodiment described above may be combined with any other suitable feature(s) of any other embodiment(s).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

What is claimed is:

1. A hair collector apparatus comprising:
a brush;
a base portion comprising:
a housing;
a motor; and
a first hub configured to:
hold a first end of the brush; and
release the brush from the housing when a removal force is applied to the first end of the brush; and
a visor adjustably coupled to the base portion and covering the brush in a neutral position of the visor, wherein:
the removal force is applied when the visor is lifted from the neutral position; and
the first hub is further configured to disengage from holding the first end of the brush when the visor is lifted from the neutral position.

2. The hair collector apparatus of claim 1, wherein:
the visor is hingedly attached to the base portion at a bottom rear of the base portion.

3. The hair collector apparatus of claim 1, wherein:

the motor is activated when the visor is pulled down from the neutral position to uncover the brush.

4. The hair collector apparatus of claim 1, wherein:

the motor is deactivated when the visor is released from being pulled down to return to the neutral position.

5. The hair collector apparatus of claim 1, wherein:

the base portion further comprises a second hub configured to hold a second end of the brush.

6. The hair collector apparatus of claim 5, wherein:

the second hub comprises a drive engagement piece that is configured to rotate the brush when the motor is activated.

7. The hair collector apparatus of claim 1, wherein:

a first side of the first hub is configured to engage with the first end of the brush;

a second side of the first hub opposite the first side comprises a loop; and the visor comprises a hook configured to engage with the loop and apply the removal force when the visor is lifted from the neutral position thereby causing the first hub to disengage from holding the first end of the brush.

8. The hair collector apparatus of claim 1 further comprising:

a mounting portion located at a rear of the base portion, wherein:

the mounting portion is configured to mount the hair collector apparatus to a fixed surface.

9. The hair collector apparatus of claim 8, wherein:

the mounting portion comprises one or more suction cups configured to attach to the fixed surface.

10. The hair collector apparatus of claim 8, wherein:

the mounting portion comprises insertion grooves.

11. The hair collector apparatus of claim 10, wherein:

the insertion grooves are configured to removably and slidably attach to suction cups configured to attach to the fixed surface.

12. The hair collector apparatus of claim 10, wherein:

the insertion grooves are configured to removably and slidably attach to hooks of a wall plate attached to the fixed surface.

13. The hair collector apparatus of claim 1, wherein:

the brush is cylindrical.

14. The hair collector apparatus of claim 1, wherein:

the brush comprises a tricot fabric.

15. The hair collector apparatus of claim 1, wherein:

the brush comprises bristles.

16. The hair collector apparatus of claim 15, wherein:

at least a portion of the bristles comprise feathered distal ends.

17. A method of providing a hair collector apparatus, the method comprising:

providing a brush;

providing a base portion comprising:

a housing;

a motor; and a first hub configured to:

hold a first end of the brush; and release the brush from the housing when a removal force is applied to the first end of the brush; and providing a visor adjustably coupled to the base portion and configured to cover the brush in a neutral position of the visor, wherein:

the removal force is applied when the visor is lifted from the neutral position; and the first hub is further configured to disengage from holding the first end of the brush when the visor is lifted from the neutral position.

18. A method of using a hair collector apparatus, the method comprising:

mounting the hair collector apparatus to a fixed surface, wherein the hair collector apparatus comprises:

a brush;

a base portion comprising:

a housing;

a motor; and a first hub configured to:

hold a first end of the brush; and release the brush from the housing when a removal force is applied to the first end of the brush; and a visor adjustably coupled to the base portion; and pulling down the visor from a neutral position of the visor covering the brush to uncover the brush, wherein:

the removal force is applied when the visor is lifted from the neutral position; and the first hub is further configured to disengage from holding the first end of the brush when the visor is lifted from the neutral position.

19. The method of claim 17, wherein:

a first side of the first hub is configured to engage with the first end of the brush;

a second side of the first hub opposite the first side comprises a loop; and the visor comprises a hook configured to engage with the loop and apply the removal force when the visor is lifted from the neutral position thereby causing the first hub to disengage from holding the first end of the brush.

20. The method of claim 18, wherein:

a first side of the first hub is configured to engage with the first end of the brush;

a second side of the first hub opposite the first side comprises a loop; and the visor comprises a hook configured to engage with the loop and apply the removal force when the visor is lifted from the neutral position thereby causing the first hub to disengage from holding the first end of the brush.

* * * * *